US005351361A

United States Patent [19]

Buchtel

[11] Patent Number: 5,351,361

[45] Date of Patent: Oct. 4, 1994

[54] CONVERSION VALVE ARRANGEMENT

[75] Inventor: Dean H. Buchtel, Louisville, Ohio

[73] Assignee: The Hoover Company, North Canton, Ohio

[21] Appl. No.: 2,205

[22] Filed: Jan. 8, 1993

[51] Int. Cl.[5] ..... A47L 9/00

[52] U.S. Cl. ..... 15/334; 15/361

[58] Field of Search ..... 15/333, 334, 337, 354, 15/361, 331

[56] References Cited

U.S. PATENT DOCUMENTS

| | | | |
|---|---|---|---|
| 1,953,944 | 4/1934 | Becker | 15/9 |
| 2,070,689 | 2/1937 | Smellie | 15/333 |
| 2,175,642 | 10/1939 | Replogle | 15/9 |
| 2,300,204 | 10/1942 | Carlson | 15/333 |
| 2,372,033 | 3/1945 | Taylor | 15/9 |
| 2,898,622 | 8/1959 | Hurd | 15/333 |
| 4,376,322 | 3/1983 | Lockhart et al. | 15/334 |
| 4,573,236 | 3/1986 | Dyson | 15/333 |
| 4,686,736 | 8/1987 | Petralia et al. | 15/334 |
| 4,782,552 | 11/1988 | Bartlett et al. | 15/361 |
| 5,134,750 | 8/1992 | King et al. | 15/333 |
| 5,222,276 | 6/1993 | Glenn, III | 15/333 |
| 5,243,734 | 9/1993 | Maurer et al. | 15/331 |
| 5,247,720 | 9/1993 | Sovis et al. | 15/334 |

FOREIGN PATENT DOCUMENTS 384501 3/1932 United Kingdom .

OTHER PUBLICATIONS

U.S. Application 07/720/017–Maurer et al–Filed Jun. 24, 1990.

*Primary Examiner*—David A. Scherbel
*Assistant Examiner*—James F. Hook

[57] ABSTRACT

An upright cleaner is provided with both above the floor and normal floor operation by the provision of a conversion valve that is driven to converted position by movement of the cleaner handle to storage position. Reconversion also may be obtained by placement of the cleaner handle again in its operative cleaner manipulative range.

13 Claims, 4 Drawing Sheets

CONVERSION VALVE ARRANGEMENT

BACKGROUND OF THE INVENTION

1. Field of the Invention

This invention relates to upright vacuum cleaners and, more particularly, to upright vacuum cleaners having conversion for above the floor hose operation.

2. Summary of the Prior Art

The use of handle movement to initiate conversion of an upright cleaner to an above the floor hose mode is old and well known. Two examples of this concept are: (1) cleaners having air hose flow movement carried by the hollow handle of the upright cleaner when the handle is in storage position and the handle communicates by a slot in it with the fan chamber, and (2) upright cleaners having valved ducting in their hard bags, with the valve driven by a reciprocating rod that engages the suction nozzle as the handle of the cleaner is moved to storage position. In neither of these cases is the conversion valving totally situated in the suction nozzle so that neither a handle nor an associated hard bag is required to furnish a part or all the valving, thus, freeing either of them from a stricture imposed by such a design parameter.

Accordingly, it is an object of this invention to provide an upright cleaner having handle initiated conversion where the conversion valve is located wholly in the suction nozzle of the upright cleaner.

It is an additional object of the invention to automatically positively drive an upright cleaner suction nozzle mounted conversion valve to converted position.

It is also an object of this invention to positively drive an upright cleaner conversion valve to unconverted position by movement of the cleaner handle to operative position.

It is a further object of the invention to provide a driving linkage between an upright cleaner's handle and suction nozzle mounted conversion valve which includes an axle, a driven fixed crank arm and a valve plate also fixed to this same axle.

It is also an object of this invention to provide an upright cleaner with a suction nozzle side mounted, rearwardly, extending duct having a conversion arrangement associated therewith and with this conversion arrangement moved to converted position by movement of the handle of the upright cleaner to stored position.

It is a still further object of the invention to provide an improved conversion valve arrangement for an upright cleaner.

SUMMARY OF THE INVENTION

The invention utilizes an upright cleaner having a suction nozzle pivoted to an upright handle movable, at least, through an operating range and a substantially upright stored position. The handle has a fixed pin near its bottom extending parallel to the axis of the handle pivot with the suction nozzle. This pin engages a linkage arrangement pivotally mounted with the suction nozzle at its pivot with the upright handle that drives a crank arm fixedly mounted on an axle turnable with respect to the nozzle. Also fixed on this axle, outboard of the crank arm, is a valve plate disposed in a suction duct, sidewardly disposed of the suction nozzle, with the side walls of this duct furnishing the pivot bearing means for the axle. This suction duct extends rearwardly from the suction nozzle mouth and then turns inwardly near the rear of the nozzle for connection to the suction side of the motor-fan system. This system is also disposed also at the rear of the suction nozzle and extends transversely thereof. The valve plate is disposed in the flow of suction air between the suction nozzle mouth and the motor-fan system and swings downwardly to seal off the mouth of the suction nozzle for hose conversion or upwardly to seal off a hose conversion port at the top of the suction duct for floor operation of the upright cleaner. A hose (not shown), conveniently stored on the side of the upright cleaner (not shown), may be connected to this hose conversion port, permanently or removably, for above the floor cleaning purposes.

BRIEF DESCRIPTION OF THE DRAWINGS

Reference may now be had to the accompanying Drawings for a better understanding of the invention, both as to its organization and function, with the illustration showing a preferred embodiment, but being only exemplary, and in which.

DETAILED DESCRIPTION OF THE INVENTION

Figure 1:
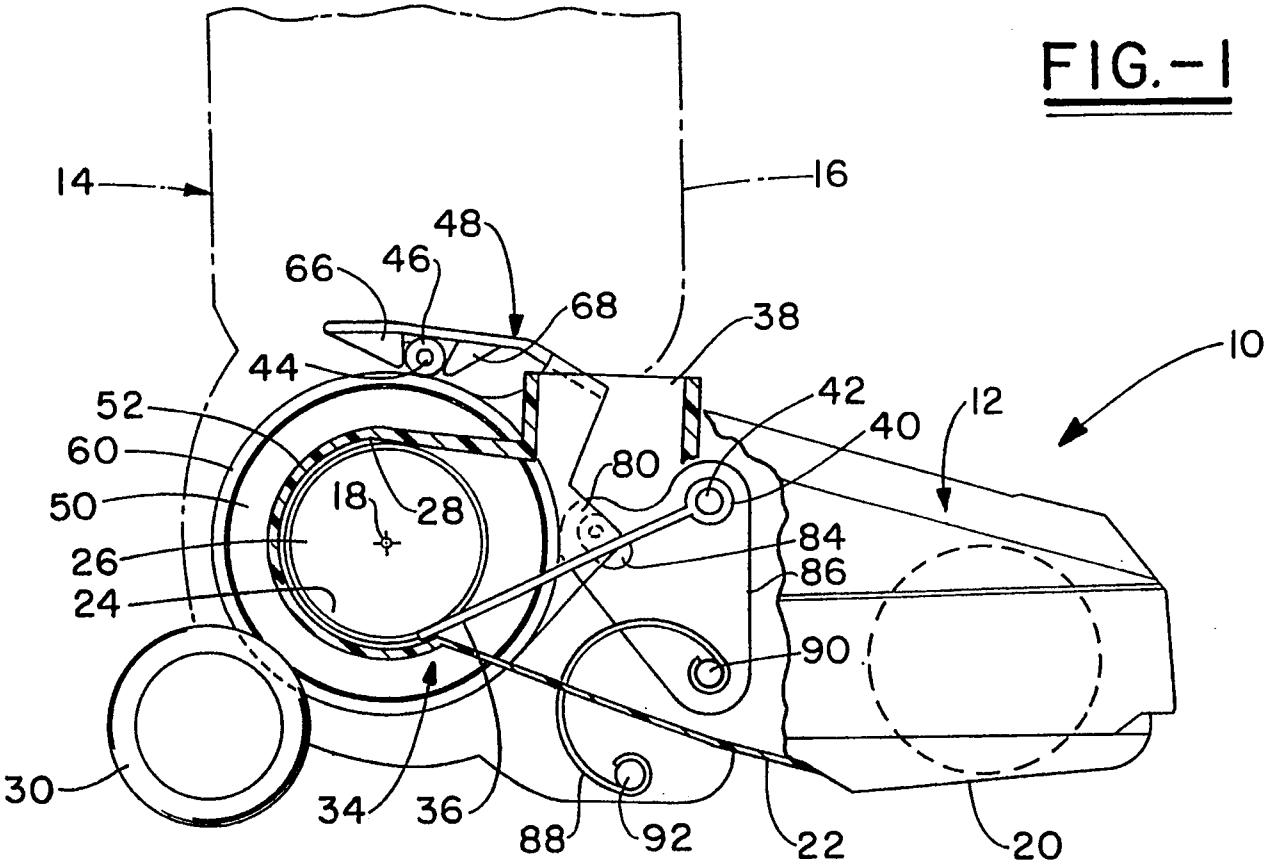
FIG. 1 is a partial side elevational view, partly sectioned, of an upright cleaner incorporating the invention with the cleaner handle shown in upright stored position.
Figure 2:
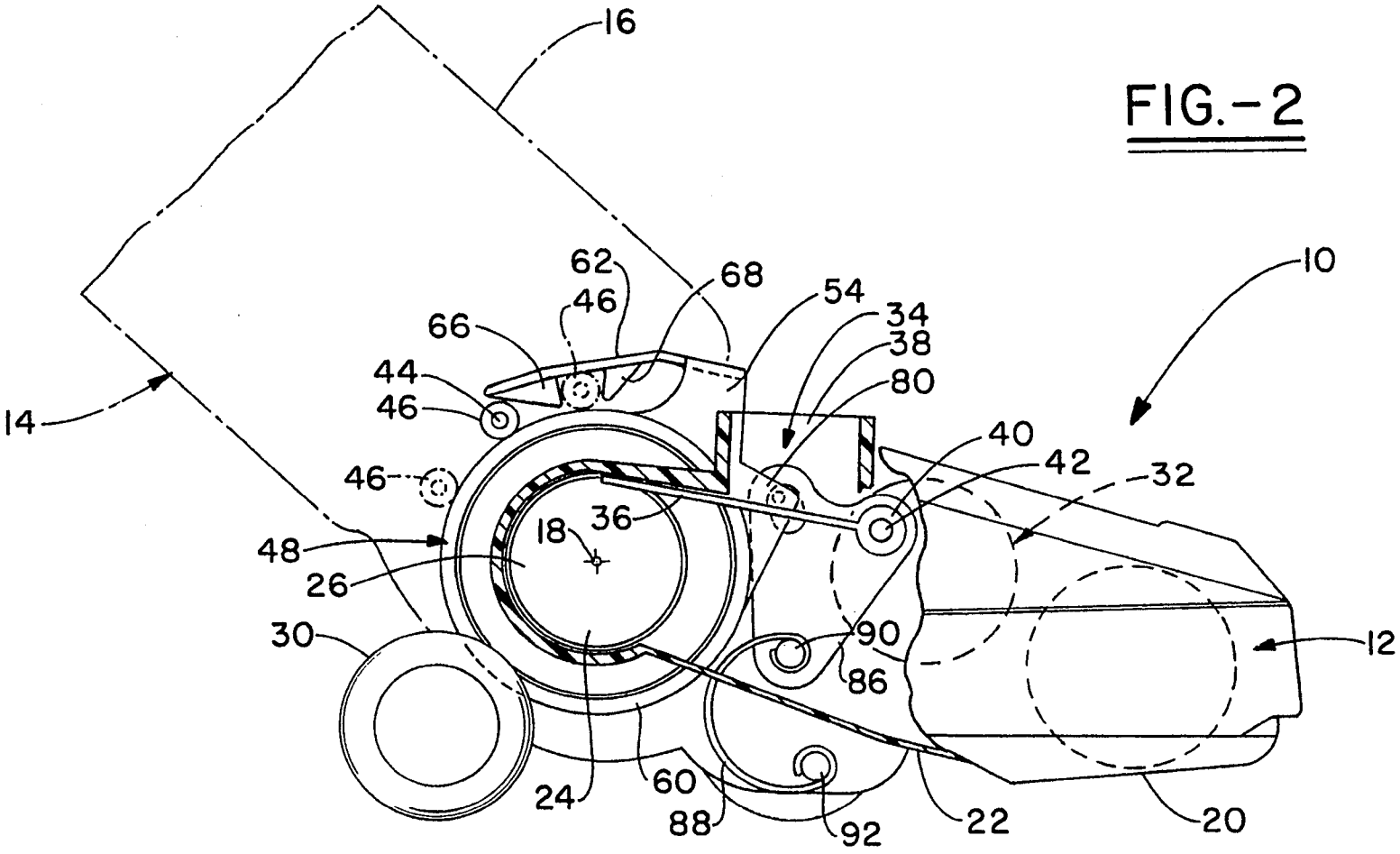
FIG. 2 is a view similar to FIG. 1 but with the cleaner handle shown in a operating position for on the floor cleaning and its drive pin in two alternate dashed line positions.

There is shown in FIGS. 1 and 2, an upright vacuum cleaner 10 having a suction nozzle 12 and a handle 14 formed partly by a hard bag housing 16 and a conventional attached upper hand grip portion (not shown). The hard bag housing 16 is pivoted to the suction nozzle, more or less conventionally, by pivot bosses fixed to the hard housing 16 which engage in stanchions or trunnions attached to the suction nozzle 12 at the rear of the nozzle 12 and bottom of the hard bag housing 16 to provide an effective pivot center 18.

The suction nozzle 12 includes, at its forward side, a suction mouth 20 which extends for generally its whole width (not shown) and communicates at its near side to a side suction duct 22 that confluently communicates with the suction mouth 20 and a suction side 24 of the fan of a motor-fan system 26. The motor-fan system 26 is conventionally disposed to axially extend transverse or widthwise at the rear of the suction nozzle 12. The suction duct 22 includes a sidewardly disposed inwardly turned portion 28 which sealingly and pivotally communicates with the suction side 24 of motor-fan system 26. An arrangement somewhat similar to what has been described in this paragraph may be found in U.S. Pat.

No. 5,134,750, owned by a common assignee and issued Aug. 4, 1992.

The suction nozzle 12 is mounted to translate over the surface being cleaned by rear wheels 30, 30 (only one shown) and may be driven, if desired, by a power drive unit 32, including driving wheels (not shown). This power drive unit is seen mounted medially, front to rear, of the suction nozzle 12.

Conversion of the upright cleaner 10 between floor and hose, off the floor modes is occasioned by a conversion means 34 including a swinging, pivoted valve plate 36 disposed within the suction duct 22, downstream of the motor-fan system 26 and upstream of the suction mouth 20 of suction nozzle 12. The pivoted valve 36 is a solid, rectangular shape like the cross sectional shape of the suction duct 22 and sized to be nearly as large. The pivoted valve plate 36 swingingly, either closes against the suction duct 22 to seal off suction mouth 20 of nozzle 12 for hose, above the floor operation (e.g., FIG. 1) or closes against an upper hose port 38 in the upper side of the duct 22 and, situated downstream and outboard of the inturned portion 28 of suction duct 22 (e.g., FIG. 2 or with the handle 14 rotated even further counterclockwise—leftward dashed position of the drive pin) for normal on the floor cleaning.

Figure 6:
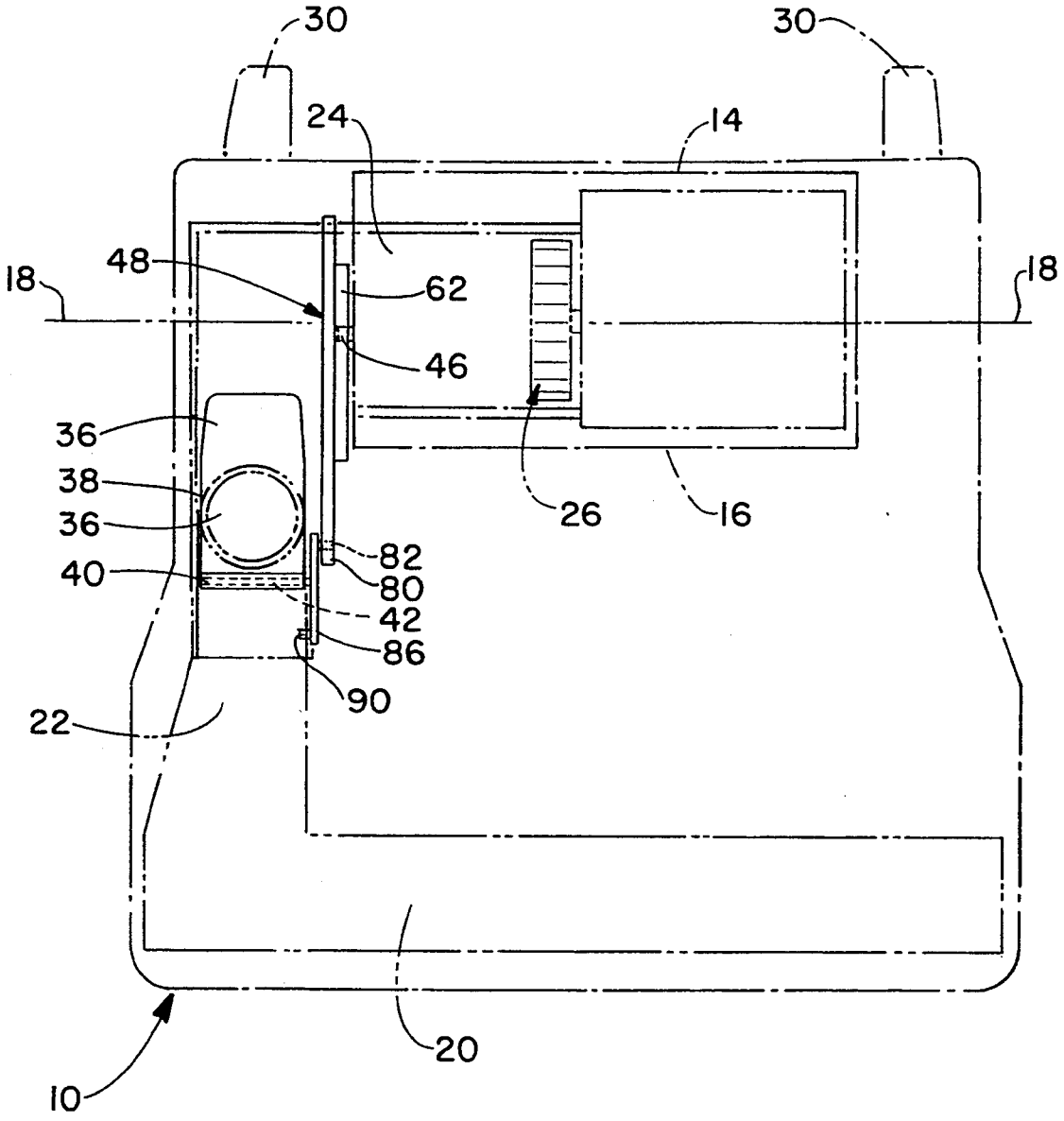
FIG. 6 is a schematic, fragmentary plan view of some of the structure of the suction nozzle and handle hard bag portion.

The pivoted valve plate 36 include an integral mounting boss 40 of cylindrical shape that extends across its upper side for substantially the full width of the suction duct 20 so as to extend along the width of this plate and prevent sideward chatter of valve plate 36 as it pivots within the suction duct 22. This boss terminates in a coaxial integral axle 42 that extends outwardly from its ends and pivots the boss 40 and its valve plate 36 to both side walls (FIG. 6) of the suction duct 22 by extending therethrough. Inwardly in the suction nozzle 12, the axle 42 extends beyond the duct 22 for connection to the remainder of the actuating linkage, while outwardly, the axle 42 terminates slightly beyond the outer side wall of the duct 22 to provide a pivot bearing only on the outboard side of the upright cleaner 10. The axle 42 is axially parallel to the axial extension of the motor-fan system 26.

The conversion valve means 34 also includes a cylindrical driving pin 44, fixedly attached to the hard bag portion 16 of the handle 14 so as to be effective to drive the remainder of the conversion valve means to either a converted or nonconverted position by engagement therewith. This pin may include a small cylindrical, hollow roller 46, mounted on it, to aid in ease of operation of the conversion valve means 34. As can be easily seen in FIGS. 1 and 2, movement of hard bag 12 clockwise or counterclockwise moves the driving pin 46 towards or away from engagement with the remainder of the conversion valve means 34.

The operation and arrangement of conversion means 34 now becomes even more apparent. An actuator ring 48 is rotatably mounted on outwardly extending hollow stanchion or trunnion 50 integral with the under structure of suction nozzle 12 and also forming the pivot center 18 for the nozzle 12 and hard bag portion 16 of handle 14. This hard bag portion may include an integral boss 52 for this purpose, with plastic inner ringing (not shown) disposed between the trunnion 50 and boss 52 to limit friction during pivoting, cleaning movement of the handle 14. Because of friction between the parts, actuator ring 48 only rotates on trunnion 50 when driving pin 44 requires such motion and, otherwise, this ring moves with trunnion 50 in its rotation relative to boss 52.

Actuator ring 48 (FIGS. 3–5) includes an outwardly jutting tab 54 having a smoothly joined curvilinear section 56 at one end and a generally tangential jointure 58 at its other so that stress concentration is limited at the juncture of this tab with a main ring 60 of actuator ring 48. The main ring 60 is a full ring and, thus, serves as the rotating portion of actuator ring 48.

Jutting tab 54 mounts a cantilever arm 62 that extends along the outer circumference of main ring 60 with a bend 64 in this arm more closely conforming it to this circumference to provide a more continuous center of rotation of this arm as actuator ring 48 rotates. The cantilever arm 62 carries two spaced, cam dog teeth 66, 68, the tooth 66 being at the distal end of cantilever arm 62, while the tooth 68 is spaced inwardly therefrom. A space 70 is then created between these two teeth, large enough to lodge the roller 46 on drive pin 44 therebetween. The tooth 66 includes a forward, leading angled edge cam ramp 72 and a reversely angled edge cam ramp 74. The tooth 68 includes a slightly forwardly angled forward limit edge 76 and a reversely more smoothly angled rearward edge 78. As illustrates, the roller 46 moves with the hard bag section 14 of handle 12 between a position of in the space 70 between cam dog teeth 66, 68 and a position counterclockwise of and removed from the space 70 and its actuator ring 48 and vice versa. This movement is occasioned by utilizing the cam ramps 72, 74 of cam dog tooth 66 to bending deform the cantilever arm 62 so that the drive pin 44 and its roller 46 may pass over the cam dog tooth 66 in either direction to insure proper driving operation of the conversion valve means 34. Because of the differing angles of the cam ramps 72, 74, passage of the roller 46 cammingly over cam tooth 66 in the direction of conversion is facilitated while passage in the opposite direction is more difficult thereby insuring a more strenuous pull on the actuator ring 48 to insure movement of valve plate 36 toward and/or into sealing position with the hose post 38.

The actuator ring 48 also includes a second lower, outwardly extending tab 80 of triangular shape having a second drive pin 82 affixed at the radially outer apex of this tab. This pin rides in a slot 84 in a triangularly shaped crank arm 86. The slot 84 provides for limited lost motion between the drive pin 82 and crank arm 86 (for, among other things, parts tolerance take up) but as the drive pin 82 moves clockwise (the handle 14 moving to storage position) it interferes with the leftward edge of the slot 84 forcing the crank arm 86 counterclockwise around a pivot center at one of its apexes, afforded by an inward extension of the axle 42. Opposite movement of the drive pin 82, similarly, moves the crank arm oppositely. The crank arm 86 is fixed to axle 42 by any conventional means, in this case, a squared axle end (not shown) which interfits with a square aperture (not shown) in crank arm 86. Since the crank arm and axle are fixed to rotate together, movement of the crank arm rotationally and swingably moves valve plate 36 fixedly with it.

An expansion bow or C spring spring 88 that acts in an overcenter way in its movement between the floor and hose conversion modes (FIG. 4 and FIG. 3) is attached to a pin 90 fixed on crank arm 86 at its last and lower apex. This spring expandingly interacts with this pin an another pin 92 fixed to the suction duct 22 or the like on the suction nozzle 12. This spring, dependent upon its positioning, constantly tries to expand to force the crank arm 86 clockwise or counterclockwise about its pivot center of axle 42 so as to act as an aid to urge the valve plate clockwise or counterclockwise, upwardly or downwardly, to close or open the hose port 38 and place the cleaner 10 in unconverted or converted condition. In each instance, the spring 88 moves over center so it tends to expandingly maintain the valve plate 76 in the position it is placed by the driving pin 44. This spring's over center action is insured by the lost motion afforded by the pin 82 and slot 84 connection.

The operation of the conversion arrangement should now be clear. If the handle 14 of the cleaner 10 is in its operative range, the handle mounted drive pin roller 46 is past the full . line position and in the most leftwardly dashed position as shown in FIG. 2. The handle 14 and its drive pin 14 can then oscillate backwardly and forwardly to provide a full range of handle positions for effective cleaning. At this position of the handle, the valve plate 36 is sealed against hose port 38 by spring 88 to insure full suction to suction mouth 20 of nozzle 12.

Figure 3:
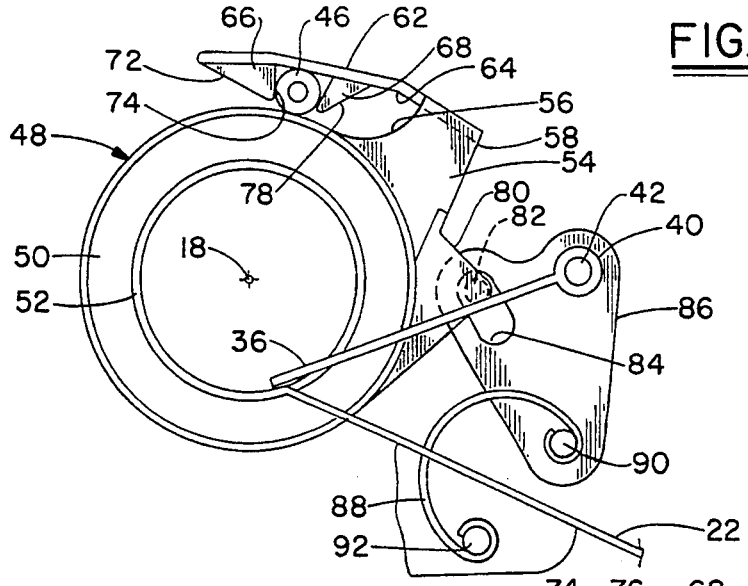
FIG. 3 is an enlarged view of the conversion valve arrangement and shown in the FIG. 1 position.
Figure 4:
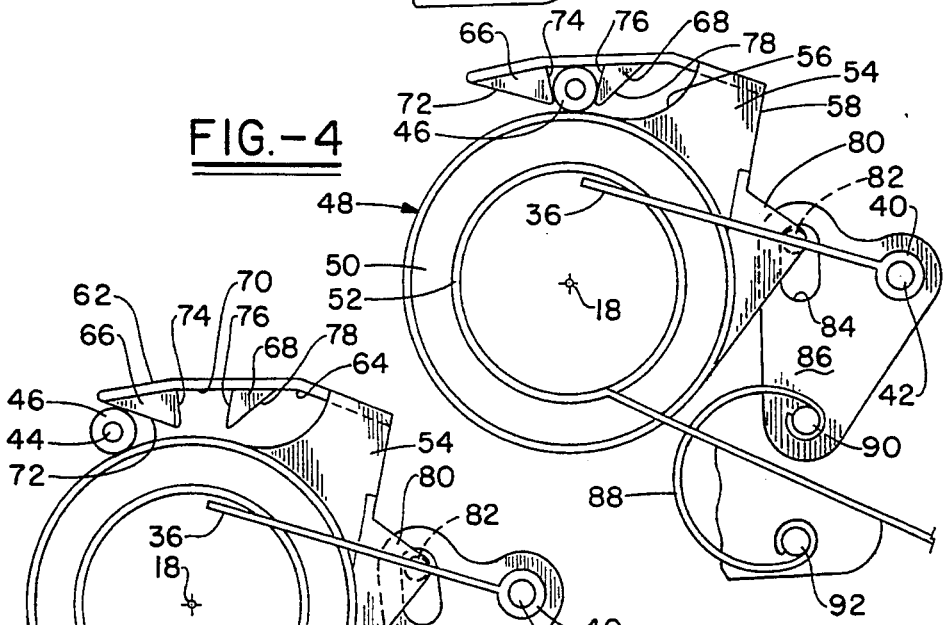
FIG. 4 is an enlarged view of the conversion valve arrangement, with the conversion linkage at an intermediate position between converted and nonconverted position.
Figure 5:
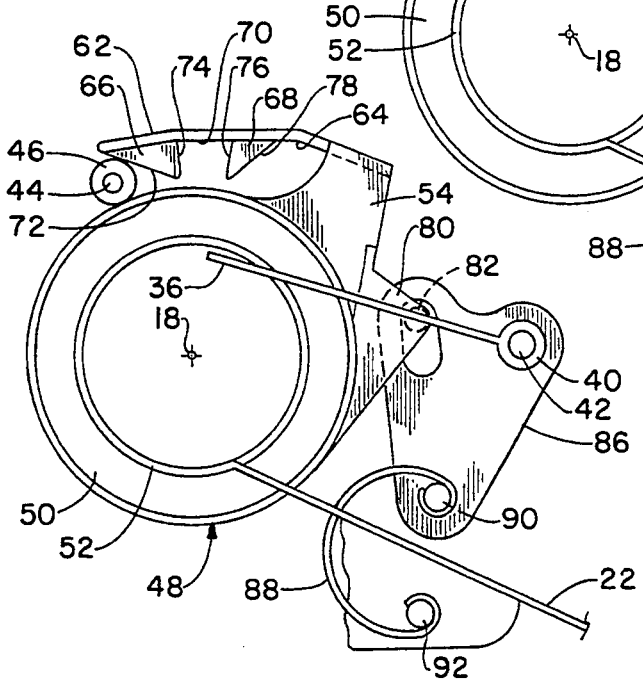
FIG. 5 also shows an intermediate position of the conversion linkage illustrating camming deflection of the actuator ring as the cleaner handle moves from or to storage condition.

In order to convert cleaner 10 to hose operation, the handle 14 is moved clockwise toward storage position, drive pin roller 46 engages against tooth 66 (full line position of FIG. 2 and FIG. 5) to cam this tooth upwardly counterclockwise so that drive pin roller 46 moves into space 70 (FIG. 4). At this time the cleaner is still unconverted. Further movement of drive pin roller 46, abuts this roller against the sharp forward edge 76 of tooth 68, positively driving the pivoting valve plate 36 counterclockwise away from hose port 38 toward and/or into suction duct 22 sealing position, dependent on parts tolerances (FIGS. 1 and 3). Expansion spring 88 aids or insures this action. The cleaner 10 is then ready for off the floor, hose operation.

In order to reconvert to floor operation, the sequence of operation is reversed and the handle 14 is moved rearwardly and counterclockwise towards its normal operating range, pulling the drive pin roller 46 in this same direction and thereby urging the crank arm 86 clockwise through the counterclockwise movement of actuator ring 48, as urged by roller 46 abuttingly engages the rearward edge 74 of tooth 66, until the valve plate 36 again seals the hose port 38. Expansion spring 88 aids or again insures this action.

The handle 14 is then rotated even further counterclockwise and the drive pin roller 46 cams cantilever arm 62 upwardly counterclockwise (the rightward dashed drive pin roller 46 in FIG. 2) so that it clears the actuator ring 48 and again is in normal floor mode (the leftward dashed drive pin roller 46 in FIG. 2). The spring 88 maintains the sealed position of the valve plate 36, having again moved over center.

It should now be clear that the invention described fully meets all the objects set out in the beginning portion of this description. It should also be clear that many modifications could be made to the invention that would still fall within its spirit and purview, such as: eliminating the pin and slot connection lost motion accommodation between the actuator ring and crank arm if not deemed necessary and/or by a differing spring arrangement.

What is claimed is:

1. An upright cleaner having conversion to an above the floor operation including:

a) a cleaner handle pivoted in an upstanding manner to a suction nozzle;

b) a suction duct in said suction nozzle conveying a flow of suction air from a forwardly mounted suction mouth of said suction nozzle towards a motor-fan system in said upright cleaner;

c) a hose port disposed in fluid communication with said suction duct;

d) a pivoting valve closure member disposed in said suction duct and movable to a first position to sealingly close against said flow of suction air from said suction mouth and a second position to open a flow path to said suction mouth;

e) said valve closure member being spring urged by a spring mean to at least one of said positions;

f) said cleaner handle having an abutting piece which, upon pivoting movement of said cleaner handle in at least one direction, aids in abuttingly driving said valve closure member against said spring to move said valve closure member to the other of said position;

g) said abuttingly piece being a pin;

h) a deformable member in driving engagement with said valve closure member; and i) said pin abuttingly engageable with said deformable member to deform it whereby said deformable member aids in moving said valve closure member against the urging of said spring.

2. An upright cleaner having conversion to an above the floor operation as set out in claim 1 wherein:

a) said deformable member includes a notch-like depression for reception of said pin.

3. An upright cleaner having conversion to an above the floor operation as set out in claim 2 wherein:

a) said pin abuttingly deforms said deformable member to thereby drivingly engage said deformable member when received in said notch-like depression.

4. An upright cleaner having conversion to an above the floor operation as set out in claim 3 wherein:

a) said pin deformingly disengages from said notch-like depression upon pivoting of said handle back in its opposite direction.

5. An upright vacuum cleaner having conversion to an above the floor operation as set out in claim 1 wherein:

a) said deformable member is in driving engagement with a pivoted link fixed to said valve to thereby pivotally drive said valve.

6. An upright vacuum cleaner having conversion for an above the floor operation as set out in claim 5 wherein:

a) a lost motion connection is disposed between said deformable member and said pivoted link.

7. An upright vacuum cleaner having conversion for an above the floor operation as set out in claim 6 wherein:

a) said link pivots in opposite directions to place said valve closure member in sealing or non-sealing relationship relative to said suction air; and b) said spring engaging with said link urges it towards at least one of said sealing and non-sealing positions.

8. An upright cleaner having conversion to an above the floor operation including:

a) a cleaner handle pivoted in an upstanding manner to a suction nozzle;

b) a suction duct in said suction nozzle conveying a flow of suction air from a forwardly mounted suction mouth of said suction nozzle towards a motor-fan system in said upright cleaner;

c) a hose port disposed in fluid communication with said suction duct;

d) a pivoting valve closure member disposed in said suction duct and movable to a first position to sealingly close against said flow of suction air from said suction mouth and a second position to open a flow path to said suction mouth;

e) said cleaner handle having an abutting piece which, upon pivoting movement of said cleaner handle in at least one direction, aids in driving said valve closure member against said spring to move said valve closure member to the other of said positions;

f) said abutting piece upon said cleaner handle moving in at least one direction for engaging against a driving linkage attached to and driving said valve closure member;

g) said linkage arrangement including a crank arm mounted to rotate with a shaft fixedly mounted to said valve closure member, said shaft rotatingly driving said valve closure member to said sealing position;

h) said shaft being rotatably mounted in opposed walls of said suction duct;

i) said duct extending in a fore and aft direction along one side of said suction nozzle; and j) said linkage including a spring means for urging said valve closure member to both its said first and second positions, said spring means urging said valve closure member to said first and second positions alternatively.

9. The upright cleaner as set out in claim 8 wherein:

a) a motor-fan system is disposed axially parallel to the axially extending direction of said shaft.

10. The upright vacuum cleaner as set out in claim 8 wherein:

a) said driving linkage includes a lost motion connection whereby tolerances of said driving linkage is accommodated.

11. The upright vacuum cleaner as set out in claim 8 wherein:

a) said spring means takes the form of only a single spring;

b) said single spring attached to said linkage and said suction nozzle and working in an over center manner.

12. An upright cleaner having conversion to an above the floor operation including:

a) a cleaner handle pivoted in an upstanding manner to a suction nozzle;

b) a suction duct in said suction nozzle conveying a flow of suction air from a forwardly mounted suction mouth of said suction nozzle towards a motor-fan system in said upright cleaner;

c) a hose port disposed in fluid communication with said suction duct;

d) a pivoting valve closure member disposed in said suction duct and movable to a first position to sealingly close against said flow of suction air from said suction mouth and a second position to open a flow path to said suction mouth; said cleaner handle having a abutting piece which, upon pivoting movement of said cleaner handle in at least one direction, aids in abuttingly driving said valve closure to move said valve closure member to said first of said positions;

f) said abuttingly piece being a pin;

g) a deformable member including a deflectable projection in driving engagement with said valve closure member; and h) said pin abuttingly engageable with said deflectable projection to elastically deform it, whereby said deformable member aids in moving said valve closure member to said first position.

13. An upright cleaner having conversion of above the floor operation as set out in claim 12 wherein:

a) said handle abutting piece engages said deflectable projection of said deformable member to also move said valve to said second position.

* * * * *